US008414259B2

(12) United States Patent
Castro et al.

(10) Patent No.: US 8,414,259 B2
(45) Date of Patent: Apr. 9, 2013

(54) METHOD FOR MANUFACTURING VANES INTEGRATED INTO A RING AND RECTIFIER OBTAINED BY THE METHOD

(75) Inventors: Enrique Penalver Castro, Soumagne (BE); Benoit Baldewijns, Hannut (BE)

(73) Assignee: Techspace Aero S.A., Milmort (BE)

( * ) Notice: Subject to any disclaimer, the term of this patent is extended or adjusted under 35 U.S.C. 154(b) by 456 days.

(21) Appl. No.: 12/791,270

(22) Filed: Jun. 1, 2010

(65) Prior Publication Data

US 2010/0322763 A1 Dec. 23, 2010

(30) Foreign Application Priority Data

Jun. 18, 2009 (EP) ..... 09163148

(51) Int. Cl.
*F01D 9/00* (2006.01)

(52) U.S. Cl. ..... 415/209.3; 29/889.22

(58) Field of Classification Search ..... 415/209.3, 415/209.4, 210.1, 191; 416/229 A, 234; 29/889.22
See application file for complete search history.

(56) References Cited

U.S. PATENT DOCUMENTS

| | | | | |
|---|---|---|---|---|
| 2,995,294 | A * | 8/1961 | Warnken | 415/209.2 |
| 6,196,794 | B1 * | 3/2001 | Matsumoto | 415/191 |
| 6,543,995 | B1 | 4/2003 | Honda et al. | |

FOREIGN PATENT DOCUMENTS

| | | | |
|---|---|---|---|
| EP | 0 602 631 | A1 | 12/1993 |
| EP | 1 317 987 | A1 | 12/2002 |
| EP | 1 936 121 | A1 | 6/2008 |
| WO | WO 2008/000014 | A2 | 1/2008 |

* cited by examiner

*Primary Examiner* — Richard Edgar
(74) *Attorney, Agent, or Firm* — Reinhart Boerner Van Deuren P.C.

(57) ABSTRACT

The present invention relates to a method for manufacturing a turbomachine rectifier comprising an outer ring (5) and a plurality of stator vanes (2), said vanes comprising a platform (9) and a blade (12), wherein said method comprises at least the following steps:

a) first folds (7) are draped over a core comprising perforations and having the shape of the aerodynamic flow;

b) optionally, the first folds (7) are cut along incisions (8) placed opposite the perforations of the core;

c) the blades (12) of the vanes or, alternatively, the blades (12) of the vane preforms, are inserted through the incisions (8) of the first folds (7) and through the perforations of the core;

d) last folds (10) are draped over the platforms (9) thus forming a rectifier preform;

e) a resin is injected into a closed mold with the preform and the resin-impregnated preform is polymerized;

f) a molded piece, essentially having the shape and dimensions of said rectifier, is retrieved from the mold.

6 Claims, 3 Drawing Sheets

(a)

(b)

METHOD FOR MANUFACTURING VANES INTEGRATED INTO A RING AND RECTIFIER OBTAINED BY THE METHOD

CROSS-REFERENCE TO RELATED APPLICATIONS

This patent application claims the benefit of European Application No. 09163148.1, filed Jun. 18, 2009, the entire teachings and disclosure of which are incorporated herein by reference thereto.

FIELD OF THE INVENTION

The present invention relates to a method for manufacturing a rectifier in a turbomachine.

It more particularly relates to a method for manufacturing composite outer rings with integrated vanes.

It also relates to the rectifier obtained as in the method.

STATE OF THE ART

Axial compressors are well known per se and are used in turbomachines, among others.

These low or high pressure compressors comprise several stages of rotating vanes that are separated by stages of rectifiers, that have the purpose of repositioning the speed vector of the fluid coming out of the preceding stage before sending it to the next stage.

These rectifier stages are essentially composed of fixed vanes, also called stator vanes, connecting an outer ring to an inner ring, both concentric and defining the air flow zone or aerodynamic flow. By way of explanation, FIG. 1 shows a cross-section of a part of a turbomachine compressor where the stator vanes fixed to the inner and outer rings can be seen (see key).

The stator vanes generally comprise a platform that is attached to the outer ring by riveting, welding, bolting, adhesion, etc. Examples of assemblies by rivets (U.S. Pat. No. 6,543,995 A) and bolts (EP 1 936 121 A) are illustrated in FIGS. 2*a* and 2*b*, respectively.

The assembly by rivets, bolts, etc. has the drawback of requiring that openings be pierced in the ring for the passage of the fastening elements, which results in a decrease of the structural resistance of the ring.

The assembly by welding (e.g. by electron beam or laser beam) also has drawbacks. It is known that welding causes, in the thermally affected zone (TAZ), deterioration of the mechanical properties. Hence, one must avoid placing any element creating strain concentrations in these weakened zones. In the particular case of a low-pressure compressor (or booster), one must avoid placing the mounting flanges of the outer rings in these zones (see in FIG. 1 and FIG. 2*b*). In practice, it is therefore necessary to distance the flanges from these zones, which results in the extension of the length of the low-pressure compressor.

Aims of the Invention

The present invention aims to provide a solution that allows to overcome the drawbacks of the prior art.

The present invention aims in particular to achieve an assembly between vanes and rings that does not weaken the mechanical resistance of the ring.

Main Characteristic Elements of the Invention

The present invention relates to a method for manufacturing a turbomachine rectifier comprising an outer ring and a plurality of stator vanes, said vanes comprising a platform and a blade, wherein said method comprises at least the following steps:

a) first folds are draped over a core comprising perforations and having the shape of the aerodynamic flow;
b) optionally, the first folds are cut along incisions placed opposite the perforations of the core;
c) the blades of the vanes or, alternatively, the blades of the vane preforms, are inserted through the incisions of the first folds and the perforations of the core;
d) last folds are draped over platforms thus forming a rectifier preform;
e) a resin is injected into a closed mold with the preform and the resin-impregnated preform is polymerized;
f) a molded piece, essentially having the shape and dimensions of said rectifier, is retrieved from the mold.

According to particular embodiments of the invention, the method comprises at least one or a suitable combination of the following features:

the first folds are pre-cut, in which case, step b) is absent;
the vane is in composite or metal material;
the vane preform is also injected with the resin in step e);
the platforms of the vanes are arranged side by side in step c);
the first and last folds comprise carbon fiber fabric.

The present invention also relates to a turbomachine rectifier obtained by means of the method as described above.

Figure 1:
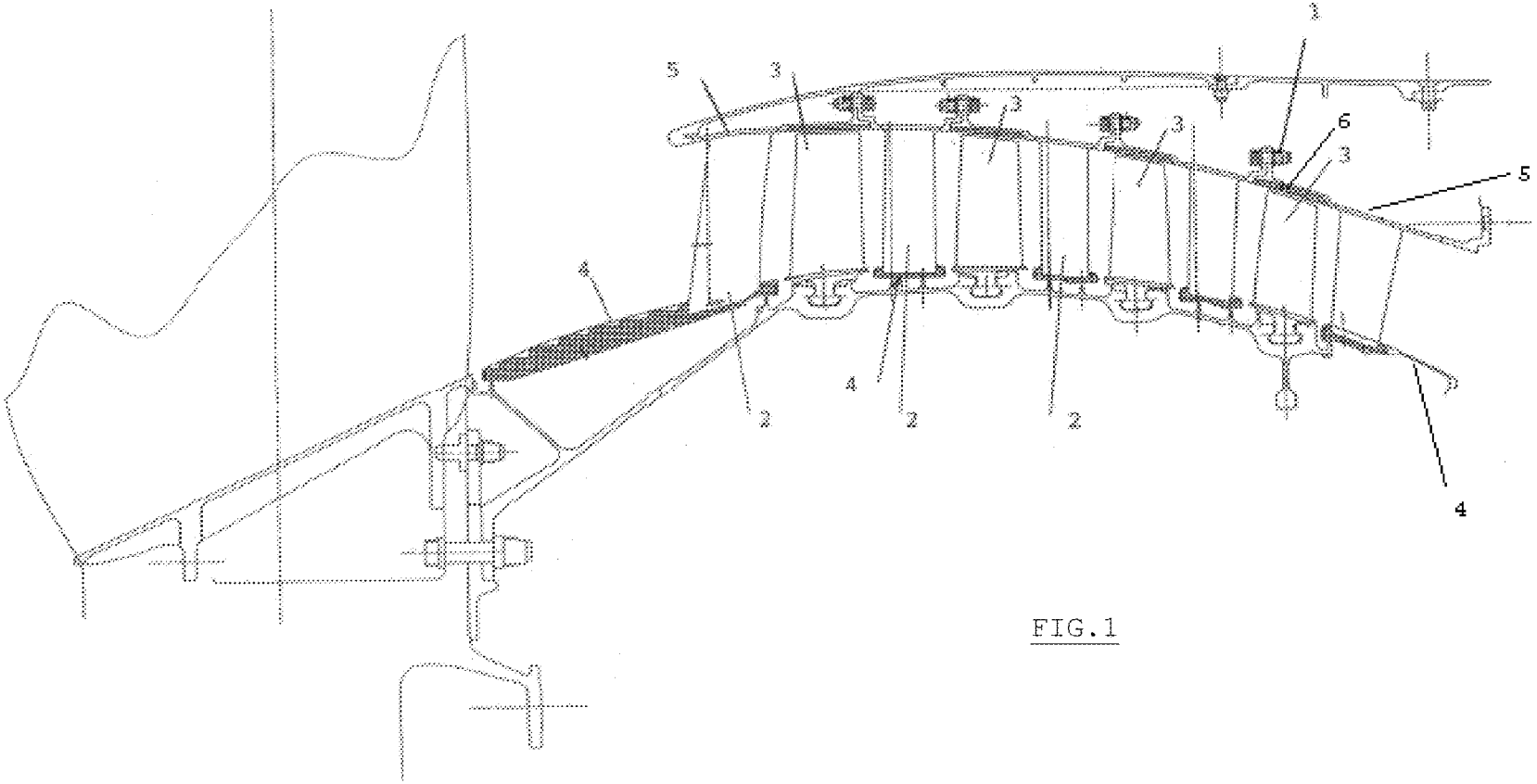
FIG. 1, already mentioned, shows a cross-sectional view of a part of a turbomachine compressor.
Figure 2:
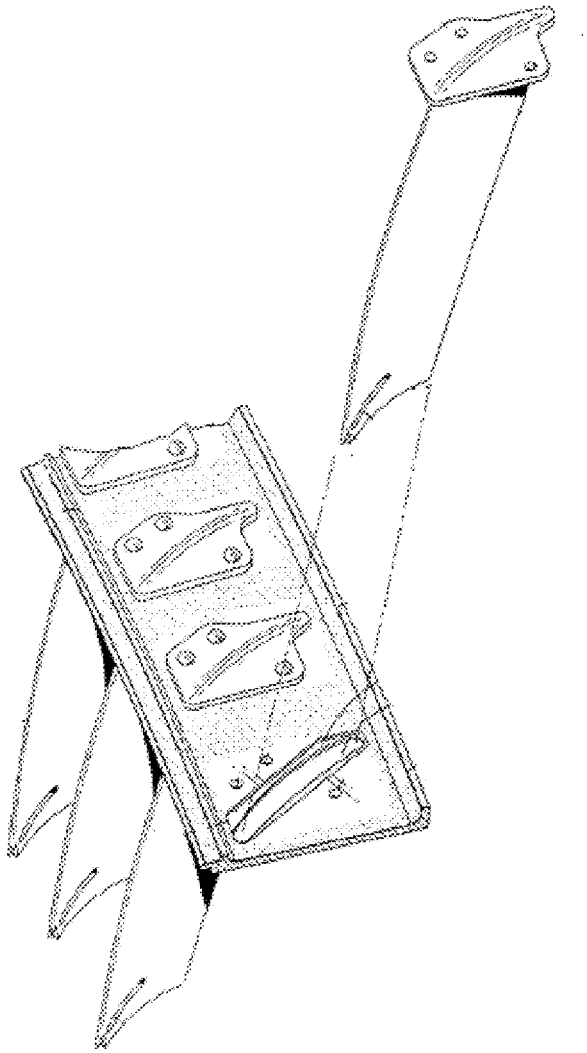
FIGS. 2*a* and 2*b*, already mentioned, show a three-dimensional view and a cross-sectional view, respectively, of examples of assemblies between stator vanes and outer ring as in the prior art.
Figure 2:
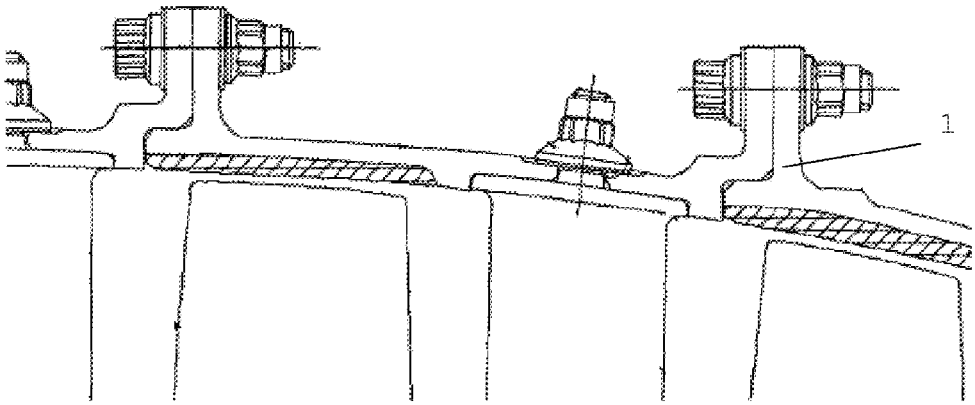

KEY (1) Mounting flange between outer rings
(2) Fixed or stator vanes
(3) Rotary vanes
(4) Inner ring
(5) Outer ring
(6) Abradable
(7) First draped folds
(8) Incision in the first folds
(9) Platform of the stator vane
(10) Last draped folds
(11) Connecting radius between the blade and the platform of the stator vane
(12) Blade of the stator vane

DETAILED DESCRIPTION OF THE INVENTION

The present invention relates to a method for manufacturing a turbomachine rectifier and, more particularly, to a method for manufacturing a composite outer ring with integrated vanes. In the present invention, the outer ring is obtained by the draping method and the vanes or vane preforms are inserted during draping between the folds.

Figure 3:
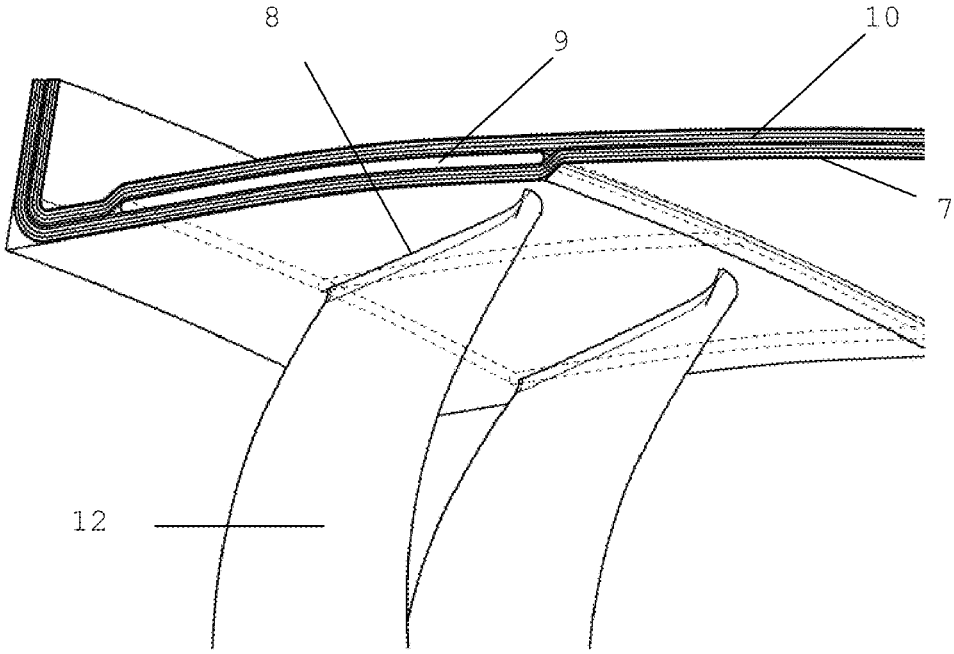
FIG. 3 shows a three-dimensional view of the insertion of the stator vanes while the outer ring is being draped as in the invention.
Figure 4:
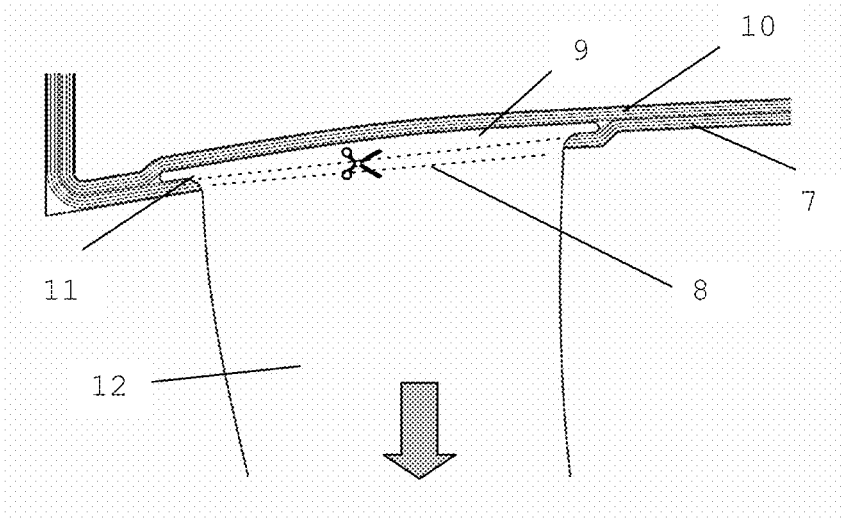
FIG. 4 shows a cross-sectional view corresponding to the assembly of FIG. 3.

The method as in the invention comprises at least six steps (see FIG. 3 and FIG. 4). A first step a) consists in draping the first folds 7 over a core comprising perforations and having the shape of the aerodynamic flow (not shown). In a second step b), the first folds are cut along an incision 8 placed opposite the perforation of the core. The first folds 7 may also be pre-cut, in which case step b) is absent. As an example, the folds may be made of carbon fiber fabric. In a third step c), the vanes and, more particularly, the vane blades 12, are inserted through the incisions 8 of the first folds 7 and through the perforations of the core in the direction of the arrow shown in FIG. 4. According to the present invention, the incisions and perforations are spaced so as to arrange the platforms side by side, i.e. connectedly, as illustrated by the broken lines in FIG. 3. The vanes may be dry preforms intended to be injected with a resin at a latter stage, or composite vanes or even metal vanes. Then, in step d), the last folds 10 are draped over the vane platforms 9 to complete the preform of the rectifier. In step e), a resin is injected into a closed mold with the preform and the impregnated preform is polymerized. In the event that the inserted vane is a dry preform, it is also injected with the resin. A last step f) consists in then opening the mold and removing the rectifier thus formed.

ADVANTAGES OF THE METHOD AS IN THE INVENTION

The aerodynamic flow does not have any flaws because a large portion of the blade/platform connecting radius 11 is found in the thickness of the ring; this allows to minimize disruptions at the aerodynamic level.

The platforms are connected to each other to ensure angular wedging as well as better mechanical resistance.

Assembly is simplified because there is no need for fastening elements such as rivets, bolts, etc.

The absence of welding does not require that the flanges are distanced from the platform/ring assembly area and, consequently, allows to reduce the length of the low-pressure compressor.

The method as in the invention allows to achieve composite outer rings and vanes, which creates a mass gain of about 13% relative to a welded assembly between outer rings and vanes made in titanium, respectively.

The invention claimed is:

1. A method for manufacturing a turbomachine rectifier comprising an outer ring (5) and a plurality of stator vanes (2), said vanes comprising a platform (9) and a blade (12), wherein said method comprises at least the following steps:

a) first folds (7) are draped over a core comprising perforations and having the shape of the aerodynamic flow;

b) the first folds (7) are either cut to form incisions (8) placed opposite the perforations of the core or pre-cut with incisions (8);

c) the blades (12) of the vanes or, alternatively, the blades (12) of the vane preforms, are inserted through the incisions (8) of the first folds (7) and through the perforations of the core;

d) last folds (10) are draped over the platforms (9) thus forming a rectifier preform;

e) a resin is injected into a closed mold with the preform and the resin-impregnated preform is polymerized;

f) a molded piece, essentially having the shape and dimensions of said rectifier, is retrieved from the mold.

2. The method as in claim 1, wherein the vane is made of a composite or metal material.

3. The method as in claim 1, wherein the vane preform is also injected with the resin in step e).

4. The method as in claim 1, wherein the platforms (9) of the vanes are arranged side by side in step c).

5. The method as in claim 1, wherein the first (7) and last (10) folds comprise carbon fiber fabric.

6. The method of claim 1, further comprising obtaining the turbo machine rectifier after the molded piece is retraced from the mold.

* * * * *